US006872155B2

(12) United States Patent
Jacome

(10) Patent No.: US 6,872,155 B2
(45) Date of Patent: Mar. 29, 2005

(54) TURF DIVOT FIXER AND GOLF TEE HOLDER WITH COVER

(76) Inventor: David E. Jacome, 242 E. Paseo De Golf, Green Valley, AZ (US) 85614

( * ) Notice: Subject to any disclaimer, the term of this patent is extended or adjusted under 35 U.S.C. 154(b) by 0 days.

(21) Appl. No.: 10/338,299

(22) Filed: Jan. 8, 2003

(65) Prior Publication Data

US 2004/0132556 A1 Jul. 8, 2004

(51) Int. Cl.[7] ..... A63B 57/00
(52) U.S. Cl. ..... 473/386
(58) Field of Search ..... 473/386–403, 473/408; D21/793; 224/918

(56) References Cited

U.S. PATENT DOCUMENTS 2,560,414 A * 7/1951 Cheney ..... 224/918
3,298,579 A * 1/1967 Smith ..... 224/918
3,870,300 A * 3/1975 Amendola ..... 473/391
4,151,937 A * 5/1979 Jarosh et al. ..... 473/406
4,982,510 A * 1/1991 Musillo ..... 473/386
5,643,113 A * 7/1997 Rodgers ..... 473/386

* cited by examiner

*Primary Examiner*—Steven Wong
(74) *Attorney, Agent, or Firm*—Trasher Associates, LLP

(57) ABSTRACT

The invention provides a tee-enabled divot fixer having a cover. The divot fixer includes a body configured to hold at least two golf tees in an approximately parallel configuration via a first cavity and a second cavity that are each configured to accept a golf tee such that a tip of a golf tee can protrude from the cavity as a tine. The body is also configured to secure at least two golf tees in place within the body via a securing mechanism that is configured to hold a first end of a cover securely to the body.

4 Claims, 2 Drawing Sheets

TURF DIVOT FIXER AND GOLF TEE HOLDER WITH COVER

CLAIM OF PRIORITY

The invention is related to, is a continuation in part of, and claims priority from co-owned and co-pending U.S. patent application Ser. No. 09/879,749 to David Jacome, entitled TURF DIVOT FIXER AND GOLF TEE HOLDER, filed on Jun. 11, 2001, which is hereby incorporated by reference in its entirety.

BACKGROUND

1. Technical Field of the Invention

In general, the invention relates to devices for golfing, and more particularly, the invention relates to golf equipment accessories used to fix turf divots.

2. Problem Statement

During sporting events, and other activities, such as golf, it is common for clumps of turf called "divots" to be lifted from the turf surface. For example, in golf it is common for the golf ball to land on the green hard enough to leave a ball mark on the green. The ball mark left by the absence of the putting green surface is called a divot. It is proper golf etiquette to repair a divot made by a ball that lands on the putting green. However, many golf players do not repair the divots, or worse, attempt to repair the divots improperly and by doing so cause further damage to the green.

Accordingly, many golf courses have professional staff who repair divots very frequently. One reason divots are repaired frequently is because should a ball land on a putting green then hit a divot, the ball's trajectory is changed from a predictable path to a path that is unpredictable. Accordingly, it is more difficult to aim properly for the hole while on the green. In the event that divots are not repaired promptly, additional and more cumbersome complications occur when the grass left within the divot dies. Therefore, proper and prompt divot repair helps maintain a golf course, and the greens in particular, in prime playing shape.

Because golf course etiquette promotes that each individual player repair the divot mark left by their shots, many players carry divot fixers with them. Unfortunately prior art divot fixers do have problems. For example, very few golfers carry more than one divot fixer with them at a time. Many golfers do not take the time and effort to properly repair a divot. Furthermore it would be advantageous to have a divot fixer that is intergratable with other common golfing equipment to provide a golfer easy access to multiple pieces of golfing equipment.

SELECTED OVERVIEW OF SELECTED EMBODIMENTS

The invention provides technical advantages as a divot fixer that holds tees and has a cover. One embodiment of the divot fixer includes a body configured to hold at least two golf tees in an approximately parallel configuration via a first cavity and a second cavity. The cavities are configured to accept a golf tee such that a tip of a golf tee can protrude from the cavity as a tine. The body is also configured to secure at least two golf tees in place within the body via a securing mechanism that is configured to hold a first end of a cover securely to the body. In one embodiment, the cover is integral with the body. In an alternative embodiment, advertising is placed on the body. Accordingly, advertisers can provide golfers with a needed tool while increasing exposure and good will towards their goods and services. In addition, golfers have access to tees in "emergency" situations when they have run out of other tees while on a course.

Of course, other features and embodiments of the invention will be apparent to those of ordinary skill in the art. After reading the specification, and the detailed description of the exemplary embodiment, these persons will recognize that similar results can be achieved in not dissimilar ways. Accordingly, the detailed description is provided as an example of the best mode of the invention, and it should be understood that the invention is not limited by the detailed description. Accordingly, the invention should be read as being limited only by the claims.

BRIEF DESCRIPTION OF THE DRAWINGS

Various aspects of the invention, as well as an embodiment, are better understood by reference to the following EXEMPLARY EMBODIMENT OF A BEST MODE. To better understand the invention, the EXEMPLARY EMBODIMENT OF A BEST MODE should be read in conjunction with the drawings in which.

AN EXEMPLARY EMBODIMENT OF A BEST MODE

Figure 1:
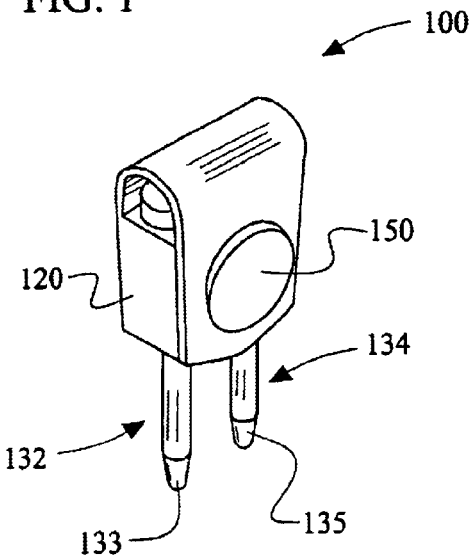
FIG. 1 shows one view of one embodiment of a flap style divot fixer and golf tee holder.

The invention teaches tee-enabled divot fixers having a cover. One embodiment of the divot fixer includes a body configured to hold at least two golf tees in an approximately parallel configuration via a first cavity and a second cavity. The cavities are configured to accept a golf tee such that a tip of a golf tee can protrude from the cavity as a tine. The body is also configured to secure at least two golf tees in place within the body via a securing mechanism that is configured to hold a first end of a cover securely to the body. In one embodiment, the cover is integral with the body. In an alternative embodiment, advertising is placed on the body. Accordingly, advertisers can provide golfers with a needed tool while increasing exposure and good will towards their goods and services. In addition, golfers have access to tees in "emergency" situations when they have run out of other tees while on a course.

Interpretation Considerations

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching"). Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for—functioning—"or "step for—functioning—" in the claims section.

Description of the Drawings

Figure 2:
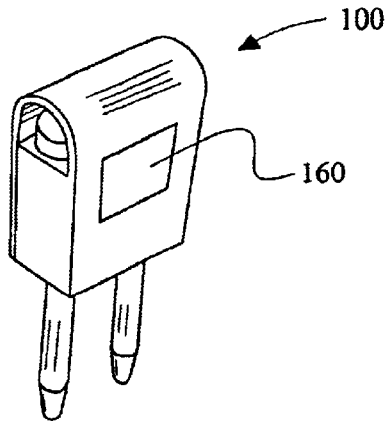
FIG. 2 provides an alternative view of the flap style divot fixer and golf tee holder of FIG. 1.
Figure 3:
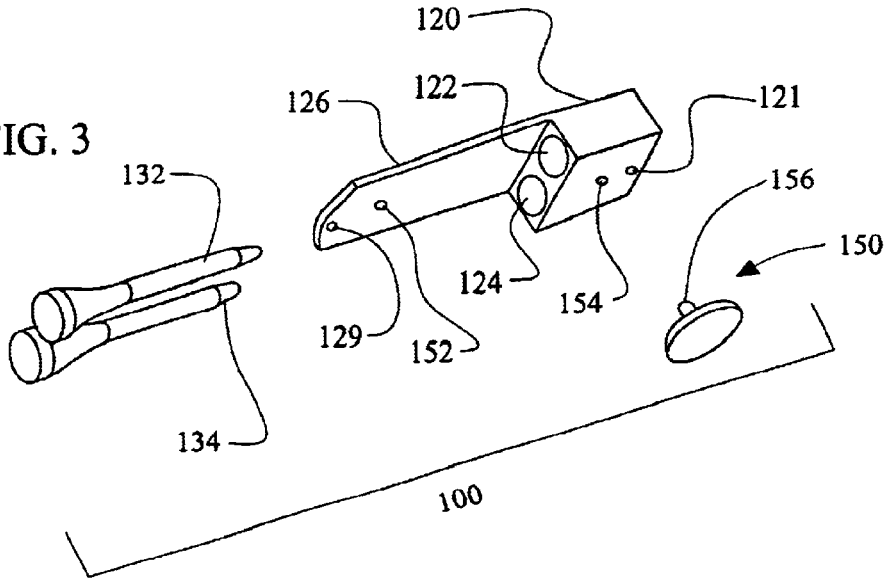
FIG. 3 is an exploded view of the flap style divot fixer and golf tee holder of FIG. 1.

Better understanding of the invention can be gained by viewing the drawings. Referring simultaneously to FIGS. 1–3, FIG. 1 shows a front view of one embodiment of a flap-style tee-enabled divot fixer (the divot fixer) 100. Likewise, FIG. 2 provides an alternative view of the flap style divot fixer and golf tee holder of FIG. 1. FIG. 3 is an exploded view of the flap style divot fixer and golf tee holder of FIG. 1.

The divot fixer 100 generally includes a body 120 configured to hold at least two golf tees 132, 134 in an approximately parallel configuration. Referring briefly to FIG. 3, The body 120 has a first cavity 122 and a second cavity 124 that are each configured to accept a golf tee such that each tip 133, 135 of each golf tee 132, 134 can protrude from each cavity so that the tips 133, 135 can be used as tines. Preferably, the body is made from a polymer plastic, such as a PVC/plastisol based plastic. However, it is readily apparent to those of ordinary skill in the art that a variety of materials, such as rubber, metal, leather or wood may also be used as body materials. In addition, it should be noted that although two cavities are shown in the Figures, a body may have any number of a plurality of cavities.

The body 120 is further configured to secure the two golf tees 132, 134 in place within the body via cover, such as a flap 126. The flap 126 is preferably integrated with the cover 120, and is thus definable as a generally planar member extending from the body 120. Preferably, the flap 126 has a securing mechanism 129, such as a peg or hook, to secure the flap 126 to the body 120. The securing mechanism 129 is preferably integrated with the flap 126. To hold the securing mechanism 129 to the body 120, the body 120 has a securing mechanism hole 121. Accordingly, the securing mechanism 129 is configured to hold the flap 126 securely to the body 120, and thus secure the tees 132, 134 within the body 120. Of course, it should be understood that equivalent functionality may be achieved by integrating a securing mechanism to the body, and producing a securing mechanism hole in the flap. In addition, it is appreciated that other equivalent variations of coupling the flap 126 to the body 120 will be readily apparent to those of ordinary skill in the art, and these variations are incorporated within the scope of the claims.

Golfers will appreciate that a ball placement marker (the ball marker) 150 provides additional advantages to the invention. Accordingly, a first hole 152 travels completely through the flap 126 and a second hole 154 is provided in the body 120. Accordingly, when the flap 126 is placed over tees 132 and 134 and secured to the body 120, a peg 156 of the ball marker 150 may pass through the holes 152, 154 and be secured to the divot fixer 100. Furthermore, from FIG. 2 one can see that advertising 160 may be affixed to the divot fixer. Of course although the ball marker 150 and the advertising 160 are shown in specific locations in the Figures, it is understood by those of ordinary skill in the art that the invention is not so limiting, and that the ball marker 150 and the advertising 160 may be located all-about the divot fixer 100 without departing from the scope of the claims.

Figure 4:
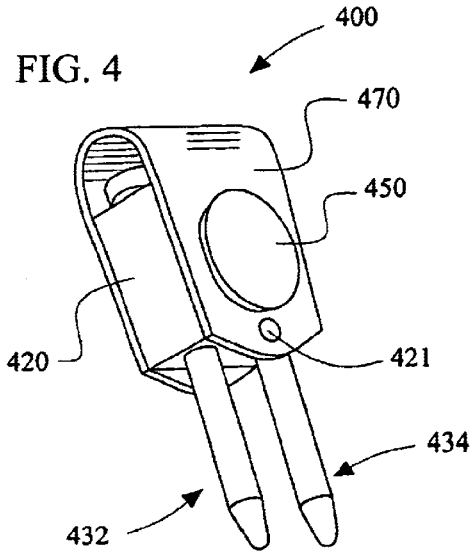
FIG. 4 shows one view of an alternative embodiment of a flap style divot fixer and golf tee holder having a removable flap.
Figure 5:
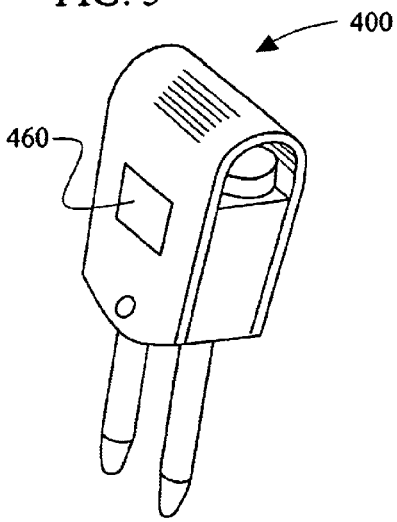
FIG. 5 provides an alternative view of the flap style divot fixer and golf tee holder of FIG. 4.
Figure 6:
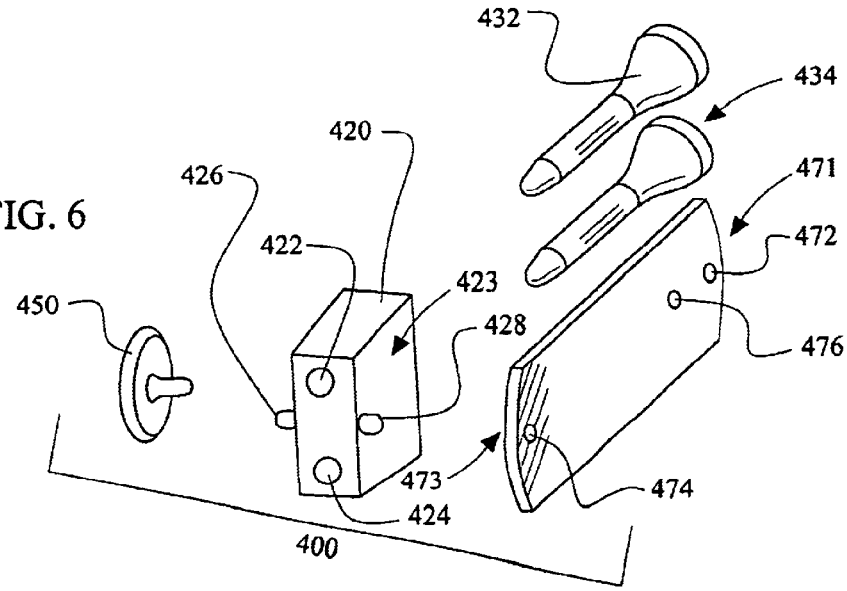
FIG. 6 is an exploded view of the flap style divot fixer and golf tee holder of FIG. 4.

Alternative functionality may be realized by examining an alternative embodiment of the invention that incorporates a separate cover. Accordingly, referring simultaneously to FIGS. 4–6, FIG. 4 shows one view of an alternative embodiment of a tee-enabled divot fixer (the divot fixer) 400 having a removable cover 470. Similarly, FIG. 5 provides an alternative view of the tee-enabled divot fixer 400. Likewise, FIG. 6 is an exploded view of the tee-enabled divot fixer 400.

Like the divot fixer 100 of FIG. 1, the divot fixer 400 generally includes a body 420 configured to hold at least two golf tees 432, 434 in an approximately parallel configuration. The body 420 has a first cavity 422 and a second cavity 424 that are each configured to accept a golf tee such that a portion of each golf tee 432, 434 protrudes from each cavity so that the tees 432, 434 can be used as tines. The alternative embodiments of materials and cavities equally apply to both the body 120 of FIG. 1 and the body 420 of FIG. 4.

The body 420 is further configured to secure the two golf tees 432, 434 in place within the body via cover 470. The cover 470 has a first end 471 and a second end 473. The first end 471 is configured to couple to a first side of the body (not shown), and the second end 473 is configured to couple to the second side of the body 423.

Preferably, the cover 470 has a first securing mechanism hole 472 and a second securing mechanism hole 474 to secure the cover 470 to the body 420. To hold the cover 470 to the body 420, the body 420 has a securing mechanism thereon, such as a first hook 426 and a second hook 428. Accordingly, the securing mechanism is configured to hold the cover 470 securely to the body 420, and thus secure the tees 432, 434 within the body 420. Of course, the use of securing mechanism holes and securing mechanisms may be reversed, or mixed. In addition, it is appreciated that other equivalent variations of coupling the cover 470 to the body 420 will be readily apparent to those of ordinary skill in the art, and these variations are incorporated within the scope of the claims.

A ball marker 450 is provided for additional golfer functionality. Accordingly, a first hole 476 completely goes through the cover 470, while a second hole (not shown) is provided in the body 420 such that the first hole 476 and the second hole align one behind the other when the cover 470 is properly coupled to the body 420. Furthermore, from FIG. 5 one can see that advertising 460 may be affixed to the divot fixer 400. Of course, the same understandings that are stated with regards to the prior embodiment are equally applicable to the present embodiment.

An alternative embodiment of the invention is a method of configuring a tee-enabled divot fixer (divot fixer). The method includes placing a tee in a first cavity of a divot fixer where the divot fixer has a first tee holder cavity and a second tee holder cavity. The tee holder cavities are each configured to accept a golf tee such that a tip of a golf tee can protrude from each cavity as a tine. In addition, the body is preferably configured to secure at least two golf tees in place via a securing mechanism to hold a first end of a cover securely to the body.

Though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

I claim:

1. A tee-enabled divot fixer, comprising:

a body configured to hold at least two golf tees in an approximately parallel configuration;

the body having at least a first cavity and a second cavity that are each configured to accept a golf tee such that a tip of a golf tee can protrude from the cavity as a tine; and the body configured to secure at least two golf tees in place within the body via a securing mechanism, the securing mechanism being configured to hold a first end of a cover securely to the body; and wherein the cover has a first end and a second end, the first end is configured to couple to a first side of the body, and the second end is configured to couple to the second side of the body.

2. A tee-enabled divot fixer, comprising:

a body configured to hold a at least two golf tees in an approximately parallel configuration;

the body having at least a first cavity and a second cavity that are each configured to accept a golf tee such that a tip of tee can protrude from the cavity as a tine; and the body configured to secure at least two golf tees in place within the body via a securing mechanism, the securing mechanism being configured to hold a first end of a cover securely to the body; and wherein the securing mechanism is a peg, and the cover has a hole at the first end such that the peg is securable in the hole.

3. A tee-enabled divot fixer, comprising:

a body configured to hold at least two golf tees in an approximately parallel configuration;

the body having at least a first cavity and a second cavity that are each configured to accept a golf tee such that a tip of a golf tee can protrude from the cavity as a tine; and the body configured to secure at least two golf tees in place within the body via a securing mechanism, the securing mechanism being configured to hold a first end of a cover securely to the body; and wherein the securing mechanism is a hole, and the cover has a peg at the first end such that the peg is securable in the hole.

4. A tee-enabled divot fixer, comprising:

a body configured to hold at least two golf tees in an approximately parallel configuration;

the body having at least a first cavity and a second cavity that are each configured to accept a golf tee such that a tip of a golf tee can protrude from the cavity as a tine; and the body configured to secure at least two golf tees in place within the body via a securing mechanism, the securing mechanism being configured to hold a first end of a cover securely to the body; and wherein the securing mechanism is a hook, and the cover has a hole at the first end such that the hook is securable in the hole.

* * * * *